United States Patent [19]

Torii

[11] 3,952,362

[45] Apr. 27, 1976

[54] NOZZLE DEVICE FOR CLEANSER FOAM SUCTION APPARATUS

[76] Inventor: Osamu Torii, No. 10-1,Ueda-8-chome, Matsubara, Osaka, Japan

[22] Filed: Nov. 16, 1973

[21] Appl. No.: 416,462

[30] Foreign Application Priority Data

Dec. 18, 1972 Japan ..... 47-127458

[52] U.S. Cl. ..... 15/353; 15/416; 15/420; 15/421

[51] Int. Cl.[2] ..... A47L 9/02

[58] Field of Search ..... 15/353, 420, 421, 415, 15/416, 410, 405

[56] References Cited

UNITED STATES PATENTS

| | | | |
|---|---|---|---|
| 993,694 | 5/1911 | Larson | 15/415 |
| 1,791,760 | 2/1931 | Kline | 15/420 |
| 2,585,186 | 2/1952 | Taylor | 15/416 |
| 2,867,231 | 1/1959 | Gerstmann | 15/353 |
| 3,314,099 | 4/1967 | Otto | 15/353 |

*Primary Examiner*—Robert W. Jenkins
*Attorney, Agent, or Firm*—Wenderoth, Lind & Ponack

[57] ABSTRACT

A suction nozzle device for a cleanser foam suction apparatus or a vacuum cleaner. The suction nozzle device comprises an intake and a suction duct. The intake has therein a guide wall means completely partitioning the hollow space of the intake into a plurality of flow passages. The guide wall means projects at its leading edge substantially beyond the lower end of the peripheral wall of the intake so as to leave one of the flow passages open to the atomosphere when the suction nozzle device is placed on a surface to be treated. The suction duct extends from the intake, and has a throttle portion formed just behind the trailing edge of the guide wall means and a diffuser succeeding the throttle portion so as to cause ejection effect at the throttle portion by the jet flow of air, which the air enters from one of the flow passages open to the atmosphere. The guide wall means may be at least one guide vane longitudinally arranged within the intake having an elongated suction opening, or may be an upside-down funnel-shaped member supported within the intake having a circular suction opening.

5 Claims, 11 Drawing Figures

NOZZLE DEVICE FOR CLEANSER FOAM SUCTION APPARATUS

The present invention relates to a suction nozzle device for use with a cleanser foam suction apparatus or a vacuum cleaner.

There is known a foam-cleaning method in which a frothable cleanser liquid is spread over the surface of an object such as carpet or the like, which is difficult to be washed whole, and then cleanser foams are produced by brushing over the surface of the object so as to absorb and remove stains therefrom. This cleaning method is characterized in that since the cleanser liquid is transformed into foams immediately after it is spread, the object to be treated is little wetted by the cleanser liquid penetrating into the object, and after cleaning, the cleanser foams are sucked and removed by using a cleanser foam suction apparatus. A conventional suction nozzle, however, in which the suction opening is contacted wholly with the object, has a weak point in that the recovery of cleanser is insufficient because the cleanser foams on the object are crushed by the lower end of the peripheral wall surrounding the suction opening. On the other hand, a special suction nozzle, wherein the peripheral wall is partially cut away so as to suck the foams, is not suitable for frothing at the inside of the nozzle. The recovery percentage of cleanser of the ordinary cleanser foam suction apparatus having the above-mentioned nozzle may remain less than 30 percent. Accordingly, it is necessary to dry the object naturally or compulsorily resulting in considerable reduction of operation efficiency.

It is an object of the present invention to provide a rational foam suction nozzle the suction opening of which is not wholly contacted with the surface to be treated in order to obviate the defects of the conventional foam suction nozzle.

Another object of the present invention is to provide a high-performance foam suction nozzle, the inside of which inside is kept at high vacuum in spite of the fact that the suction opening is not wholly contacted with the surface being treated.

A further object of the present invention is to provide a high-efficiency foam suction nozzle device making it possible to replace an exclusively foam suction apparatus with large capacity and high vacuum blower with a conventional vacuum cleaner of small dimensions.

A still further object of the present invention is to provide a suction nozzle device which can be used not only as a foam suction apparatus but also as a vacuum cleaner for dust only.

The above and other objects of the present invention will become apparent from the following detailed description of the invention in reference to the accompanying drawings.

In the drawings.

Throughout the drawings similar parts and elements are shown by similar reference numerals and letters.

Figure 1:
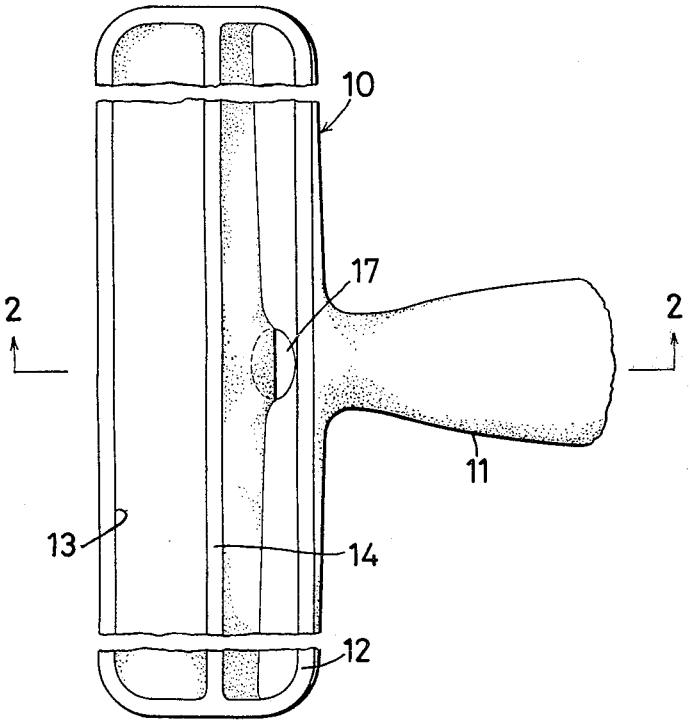
FIG. 1 is a bottom plan view of a suction nozzle device according to the present invention.
Figure 2:
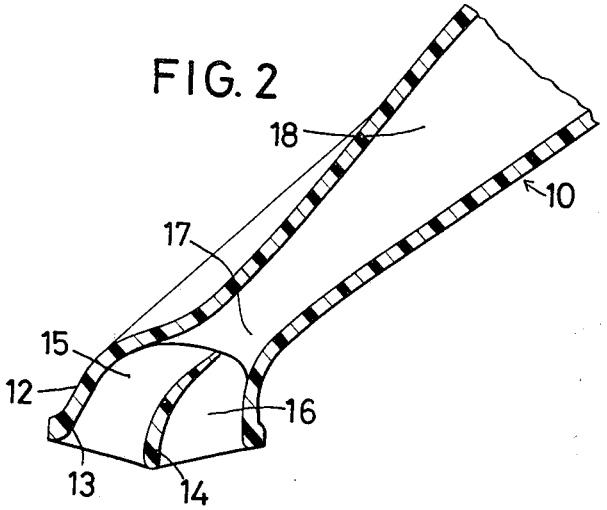
FIG. 2 is a sectional view taken substantially along the line 2 - 2 in FIG. 1.

Referring first to the typical construction shown in FIG. 1 and FIG. 2, a suction nozzle device 10 of the present invention comprises a suction duct 11 which is to be connected to a flexible hose communicating with a vacuum cleaner, and an intake 12 having a suction opening 13 and a guide vane 14. Said guide vane partitions the hollow space of said intake into a front flow-passage 15 and a rear flow-passage 16. In addition the leading edge (i.e. lower end) of said guide vane 14 is arranged to project substantially beyond the plane including the front lower end and the rear lower end of the peripheral wall of said intake so as to leave either of the flow-passages 15, 16 open to the atmosphere when the suction nozzle device is placed on the surface to be treated. Preferably the trailing edge (i.e. upper end) of said guide vane is shaped into a wedge-like form. Said suction duct 11 is provided with a throttle portion 17 that is formed just behind said trailing edge of guide vane and with a diffuser (i.e. a divergent pipe) 18 succeeding said throttle portion. Furthermore, said suction opening 13 is elongated in the direction transverse to the movement of said suction nozzle device along the surface to be cleaned.

The operation of the suction nozzle device described hereinbefore will now be explained together with the behavior of foams.

Figure 3:
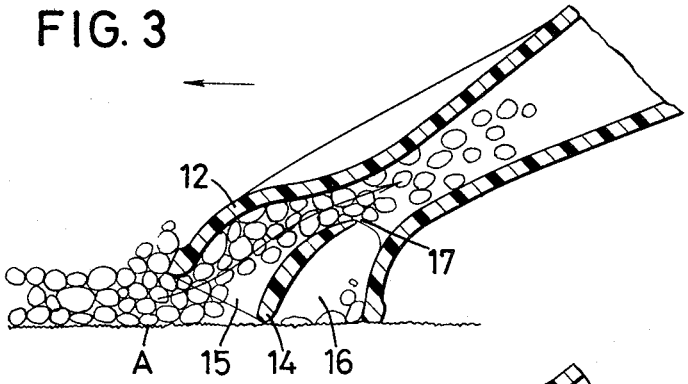
FIG. 3 to FIG. 5 are vertical views in section illustrating the operations of the suction nozzle device shown in FIG. 2.
Figure 4:
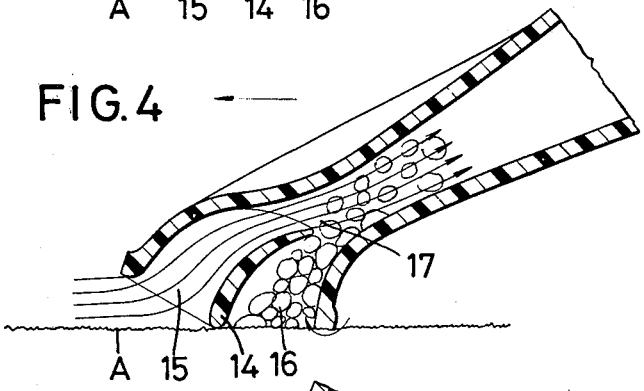
Figure 5:
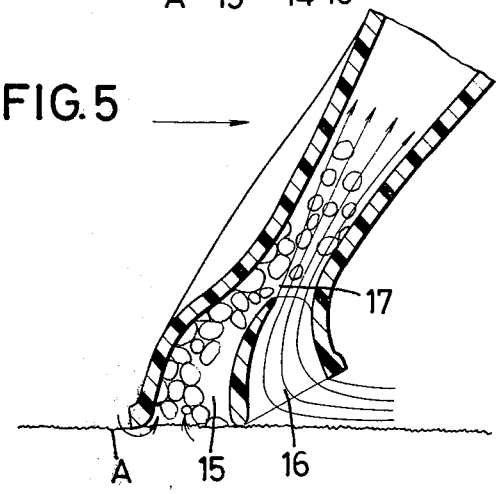

FIG. 3 illustrates a situation where the nozzle device is being slid forward in the direction of the arrow after cleanser foams have been accumulated on the surface of an object A being treated. As will be seen from this figure, the cleanser foams are not crushed by the lower end of the peripheral wall of the intake and are sucked into the suction nozzle device through the front passage 15. Though the frothing within the rear passage 16 is still dull, because the velocity of the flow carrying the foams is not so high at the throttle portion 17 owing to the inlet loss head of fluid, and then the pressure within the rear passage 16 is little reduced. On the contrary, when there are no cleanser foams on the object A, the velocity of the air flow passing through the throttle portion 17 becomes high owing to a decrease in loss head. As a result the pressure within the rear flow passage 16 is reduced very much, and the cleanser foams, which are being frothed due to decrease in pressure, are ejected into the throttle portion 17. Namely an ejection effect (in other words an entrainment effect) by a jet flow takes place within the throttle portion 17, which will be seen in FIG. 4. Accordingly, the present suction nozzle device is simultaneously and continuously effective for both the operations of the vacuum frothing of cleanser liquid and the entrainment of the same. FIG. 5 shows a condition in which the suction nozzle device 10 is being slid backwards in the direction of the arrow. The state of the air stream and the production and the entrainment of the foams are almost similar to those described in reference to FIG. 4 except that the relation between the front and rear passages of the intake is reversed.

Figure 6:
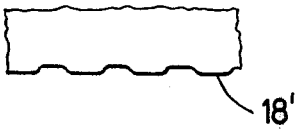
FIG. 6 and FIG. 7 are fragmentary enlarged views in elevation and in bottom plan respectively, showing ruggedness on the lower end of the peripheral wall surrounding the suction opening as well as the leading edge of a guide vane.
Figure 7:
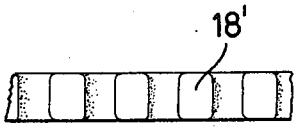

Cleanser foams frothing near the lower end of the peripheral wall of the intake tend to creep up along the inner surface of the peripheral wall towards the throttle portion by their efforts (viz. with the help of the property of Surface Active Agent), and this phenomenon is accelerated by only a slight pressure gradient owing to the leaking air which comes in through the gap between the lower end of the peripheral wall and the object A. Accordingly, it is advisable that cleanser foams produced on the surface to be cleaned be gathered together toward the inner surface of the peripheral wall by means of the back and forth sliding of the suction nozzle device. The purpose of a ruggedness 18', which is provided on the lower end of the peripheral wall and also on the leading edge of the guide vane 14 as shown in FIGS. 6 and 7, is to promote the above mentioned effect. It is also reasonable to finish the inner surface of the peripheral wall as smooth as possible.

Various modifications of the present invention are introduced as follows.

Figure 8:
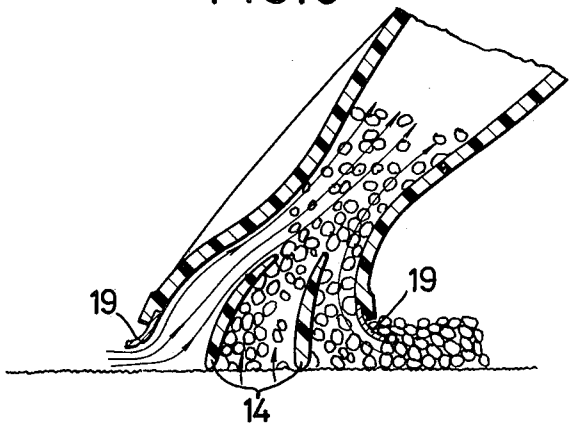
FIG. 8 shows a vertical section of a suction nozzle device illustrating another embodiment of the present invention.

A suction nozzle device having a plurality of guide vanes 14, is shown in FIG. 8. Each of the leading edges of the guide vanes also projects substantially beyond the plane including the lower end of the peripheral wall of the intake. In this case, however, a flexible skirt 19 is attached onto the lower end of the peripheral wall. The operation of the suction nozzle device and the behaviour of foams are similar to those described previously, though they are more convenient in practical use.

Figure 10:
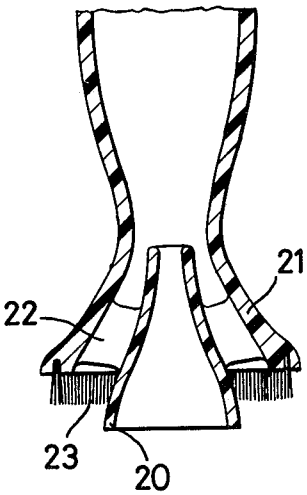
FIG. 10 shows a vertical section of the same.
Figure 9:
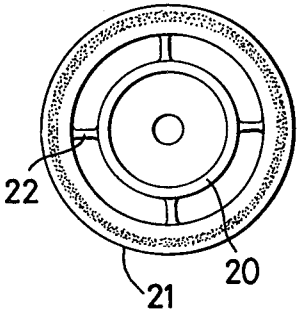
FIG. 9 is a bottom plan view of a suction nozzle device showing a further embodiment of the invention.

FIG. 9 and FIG. 10 illustrate further embodiment developed from the forgoing structures. As seen from these figures, a guide means 20, which corresponds to the preceding guide vane, is shaped into an upside-down funnel-like form, and is supported firmly within a concentric peripheral wall 21 of the intake by means of a plurality of radial ribs 22. This embodiment has an advantage of enabling the suction nozzle device to be slid in optional directions. The numeral 23 designates an optional brush mounted on the lower end of the peripheral wall, which may be eliminated as desired.

Figure 11:
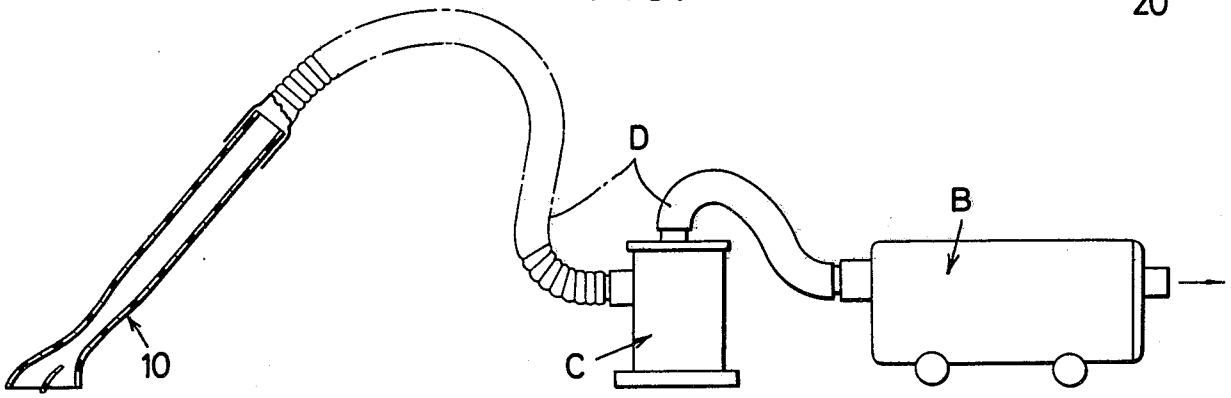
FIG. 11 is a schematic diagram showing a cleanser foam suction apparatus comprising in combination a conventional vacuum cleaner, and air-liquid separator and a suction nozzle device according to the present invention.

As mentioned above the suction nozzle device of the present invention achieves an excellent performance notwithstanding the fact that the suction opening is not wholly in contact with the object to be treated. Therefore, the suction nozzle device can be used not only for a vacuum cleaner but also for a cleanser foam suction apparatus by combining the suction nozzle device 10, a conventional vacuum cleaner B and an air-liquid separator C of small dimensions arranged on a suction line D, as shown in FIG. 11.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A suction nozzle device to be connected to a vacuum source for removing material from a surface being treated comprising:

hollow intake means having an inlet portion and an outlet portion for receiving and discharging the material to be carried away from the surface and the air coming from the atmosphere by the applied suction;

guide wall means arranged within and projecting beyond the inlet to said intake means for partitioning the hollow space of said inlet means into a plurality of flow passages having inlet openings at the inlet portion of said intake means, said flow passages being completely isolated from each other between the inlet openings of said flow passages and the discharge portion of said intake means, and for leaving at least one inlet opening of said flow passages open to the atmosphere when the intake means is placed against the surface to be treated; and ejector means extending from the discharge portion of the said intake means for connecting said intake means to a vacuum source, said ejector means having a throttle portion formed at the trailing edge of said guide wall means in said discharge portion and a diffuser portion succeeding said throttle portion.

2. A device as claimed in claim 1, wherein:

said intake means has a circular suction opening for contact with the surface to be treated, and said guide wall means is comprised of an inverted funnel-shaped member concentrically held within said circular suction opening, the narrow portion held within said intake means, and the wide portion extending beneath said intake means.

3. A device as claimed in claim 1, wherein:

the edge of said intake means which contacts the surface being treated is formed with ridges, and the leading edge of said guide wall means which contacts the surface being treated is formed with ridges.

4. A suction nozzle device as claimed in claim 1, wherein:

said intake means has an elongated suction opening for engaging the surface to be treated; and said guide wall means is comprised of a guide vane longitudinally arranged within said elongated section opening with its leading edge projecting substantially beyond said intake means.

5. In an apparatus for removing fluids from a surface having a suction nozzle device, a vacuum cleaner connected to said nozzle device by a suction line, and an air liquid separator arranged in the suction line connecting said suction nozzle device to said vacuum cleaner for removing frothable cleanser liquid from the surface being treated, an improved suction nozzle device comprised of:

hollow intake means having an inlet portion and an outlet portion for receiving and discharging the material to be carried away from the surface and the air coming from the atmosphere by the applied suction;

guide wall means arranged within and projecting beyond the inlet to said intake means for partitioning the hollow space of said intake means into a plurality of flow passages having inlet openings at the inlet portion of said intake means, said flow passages being completely isolated from each other between the inlet openings of said flow passages and the discharge portion of said intake means, and for leaving at least one inlet opening of said flow passages open to the atmosphere when the intake means is placed against the surface to be treated;

and ejector means extending from the discharge portion of said intake means for connecting said intake means to a vacuum source, said ejector means having a throttle portion formed at the trailing edge of said guide wall means in said discharge portion and a diffuser portion succeeding said throttle portion.

* * * * *